US012349792B1

(12) United States Patent
Franklin

(10) Patent No.: US 12,349,792 B1
(45) Date of Patent: Jul. 8, 2025

(54) ITEM RETAINING DEVICE FOR DRAWERS

(71) Applicant: Morris Franklin, East Orange, NJ (US)

(72) Inventor: Morris Franklin, East Orange, NJ (US)

( * ) Notice: Subject to any disclaimer, the term of this patent is extended or adjusted under 35 U.S.C. 154(b) by 124 days.

(21) Appl. No.: 18/506,310

(22) Filed: Nov. 10, 2023

(51) Int. Cl.
*A47B 88/919* (2017.01)

(52) U.S. Cl.
CPC ..... *A47B 88/919* (2017.01)

(58) Field of Classification Search
CPC ..... A47B 88/919; A47B 2210/08
See application file for complete search history.

(56) References Cited

U.S. PATENT DOCUMENTS 1,120,028 A * 12/1914 Cole ..... A47B 88/919 312/297
1,704,964 A * 3/1929 Dilg ..... A47B 88/919 312/334.47
2,614,019 A * 10/1952 Olson ..... B42F 17/02 312/273
7,699,414 B1 4/2010 Shevrin
2006/0152116 A1 7/2006 Shevrin

* cited by examiner

*Primary Examiner* — Bradley Duckworth
(74) *Attorney, Agent, or Firm* — Sanchelima & Associates, P.A.; Jesus Sanchelima; Christian Sanchelima

(57) ABSTRACT

An item retaining device for slide-out drawers comprising a mounting strip with curled upstanding tines is disclosed. The device is mounted to the rear side of a slide-out drawer assembly to prevent contents from falling out the back when the drawer is pulled out. The mounting strip has an elongated rectangular shape with openings to receive fasteners to attach to the drawer rear side. The curled tines extend upward from the top edge of the mounting strip and past the upper perimeter of the drawer sides. This allows the tines to retain items that exceed the drawer capacity or move abruptly when the drawer is opened. The tapered tines are equidistant from each other. The device provides an effective barrier to retain drawer contents without obstructing access.

10 Claims, 3 Drawing Sheets

ITEM RETAINING DEVICE FOR DRAWERS

BACKGROUND OF THE INVENTION

1. Field of the Invention

The present invention relates to attachments for drawers and, more particularly, specifically a retaining device mounted on the rear side of the drawer to prevent the contents from falling out

2. Description of the Related Art

Several designs for furniture or accessories for furniture as well as accessories or additional elements for drawers have been designed in the past. However, none disclose upward curled tines protruding above drawer height to effectively retain overflowing contents when a drawer is abruptly opened, as in the present invention. The current invention provides a novel barrier design to prevent drawer contents from falling out.

Applicant believes that a related reference corresponds to U.S. Pat. No. 7,699,414 issued for Drawer cover to prevent jams. The "414" reference, teaches A cover for a drawer to prevent objects placed therein from obstructing the movement of the drawer when it is opened or closed. The cover has a guard member in the form of a sheet with a flange member secured on one end there of. The flange member in conjunction with at least one fastener secures the cover to the drawer back. The at least one fastener may be a screw, bolt, or other similar fastener. The flange member may be provided with a number of apertures that corresponds to the number of fasteners. The at least one fastener may be a hook and loop fastener commonly known as Velcro®. The hook and loop fastener allows the user to install and remove the cover without the use of tools.

Applicant believes that another related reference corresponds to U.S. patent publication No. 20060152116 published for Jammed Drawers No More. The "116" reference, teaches a device would save time and wasted energy. It would also prevent drawers from jamming and eventually becoming broken. It would save the integrity of many useful kitchen utensils. This product will be easy to install and easy to keep clean. Because it is a clear material it makes it easy to see what's in the back of your drawers. Placing things in your drawer worry free offers peace of mind every time you put away your utensils and it will make opening your drawers easy every time. This will also prevent other things from falling behind drawers. This invention "Jammed Drawers No More" will work with or without drawer utility organizers. "Jammed Drawers No More" will enable cutlery drawers, flatware drawers, the "junk drawer" or just about any other drawer free from jamming and losing things out the back. This is my original idea and is not being sold in any stores and is not being offered as part of a cabinet accessory in any kitchen store that I have researched.

None of these references, however, teach of an item retaining device for drawers that is comprised of a strip which contains a plurality of curled upstanding tines which is attached to the rear wall of a slide-out drawer where the devise is used to prevent items from falling out the backside of the drawer.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a device to prevent items from falling from the back end of the drawer during forward motional operation of the drawer.

It is another object of this invention to provide a device that can be easily attached to the inside of any cabinet drawer.

It is still another object of the present invention to provide a device that helps prevent hassles and lost items.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
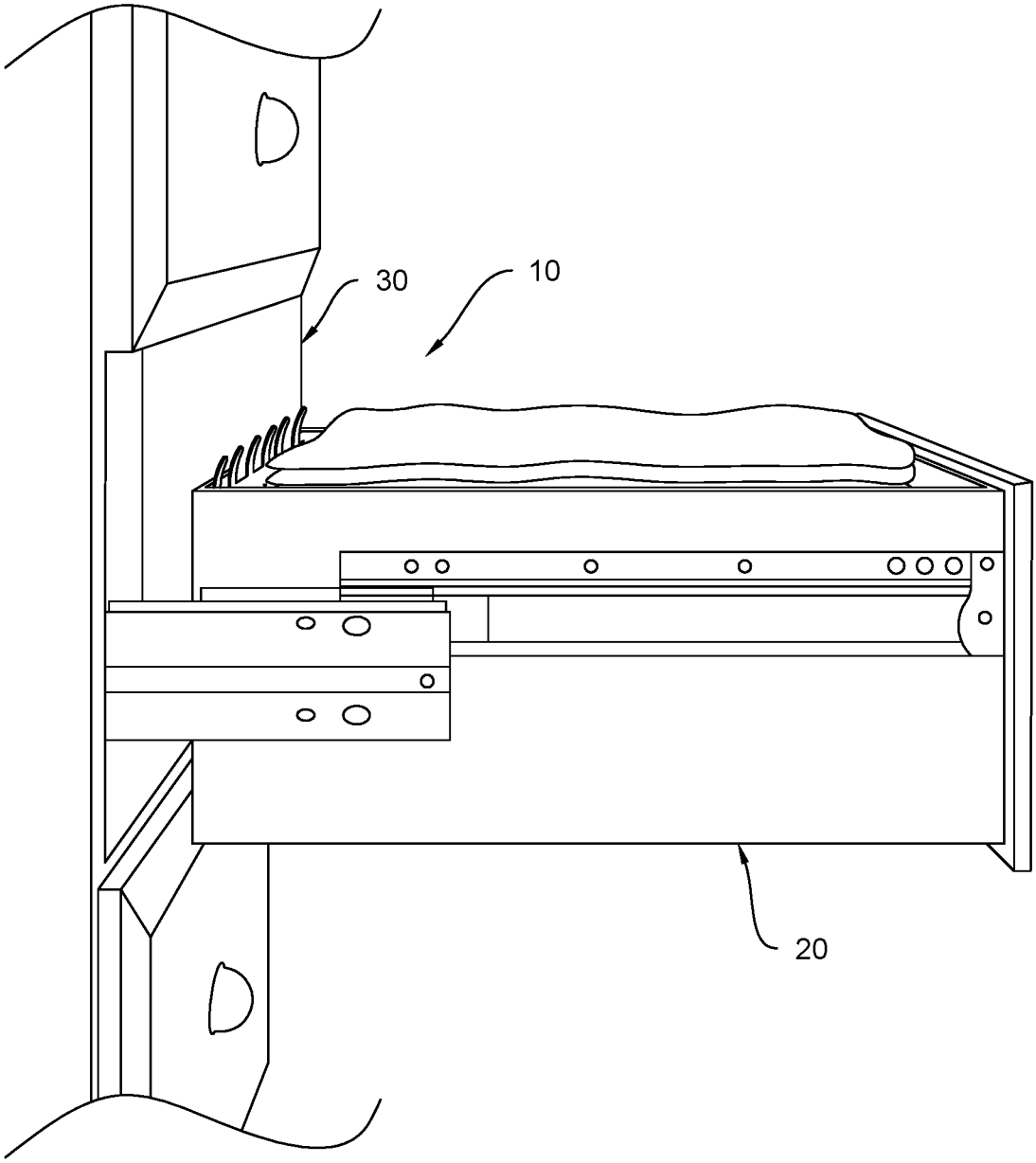
FIG. 1 represents an operational view of the present invention according to one embodiment.

Referring now to the drawings, where the present invention is generally referred to with numeral 10, it can be observed that it basically includes a drawer assembly 20, a drawer cabinet 30 and a retainer assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The drawer assembly 20 includes a front side 21, a back side 22, lateral sides 23, a base 24, a pull 25; wherein the aforementioned elements of the drawer assembly 20 may form a drawer box. In various exemplary embodiments, the drawer assembly 20 may need hardware that allows it to move in and out of the drawer cabinet assembly 40, such a hardware may be termed as drawer slides 26. Therefore, the drawer 20 may be a slide-out drawer. The drawer assembly 20 may be made of a sturdy and rigid material, as widely known in the art. In various embodiments, the drawer assembly 20 may be made of wood, fibers, plastics, metals, or any other suitable material from the art. The general geometry of the drawer may be subject to the shape of the base 24, which may be the panel that sits on the bottom edges of the drawer box and supports the contents.

The drawer cabinet 30 may be the structure that may support at least one of said drawer assembly 20. In one embodiment, the drawer cabinet 30 may be a cabinet or furniture piece that has one or more drawers built into it. The drawer cabinet 30 may be made of various suitable materials, such as wood, metal, plastic, or the like. In different exemplary embodiments, the drawer cabinet 30 may come in a range of sizes and geometries to suit different storage needs and preferences. In exemplary embodiments (not shown), the drawer cabinet 30 may present additional features, such as shelves, doors, locks, or the like. The drawer assembly 20 may be extended or retracted within the drawer cabinet 30 by means of the drawer slides 26.

Figure 2A:
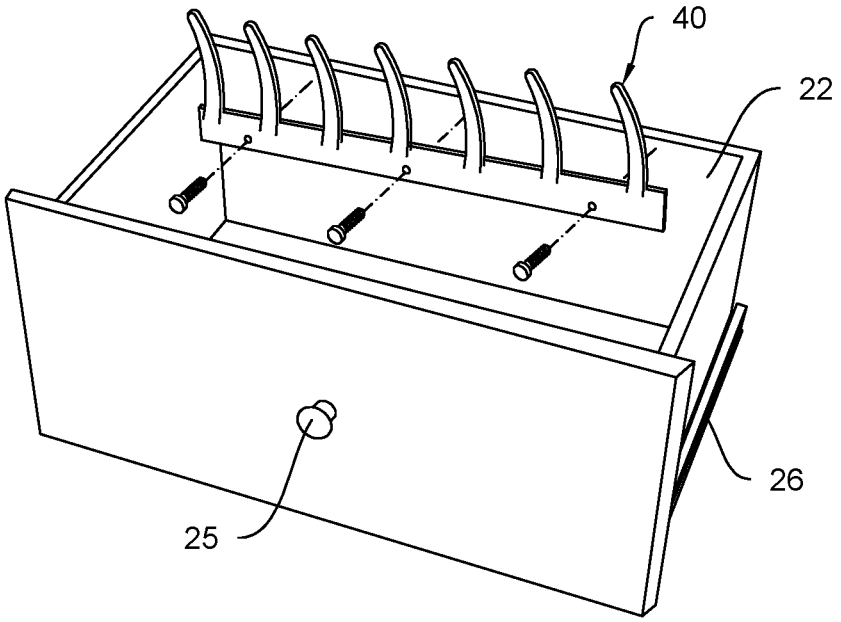
FIG. 2A shows an isometric exploded view of the invention according to one embodiment.
Figure 3:
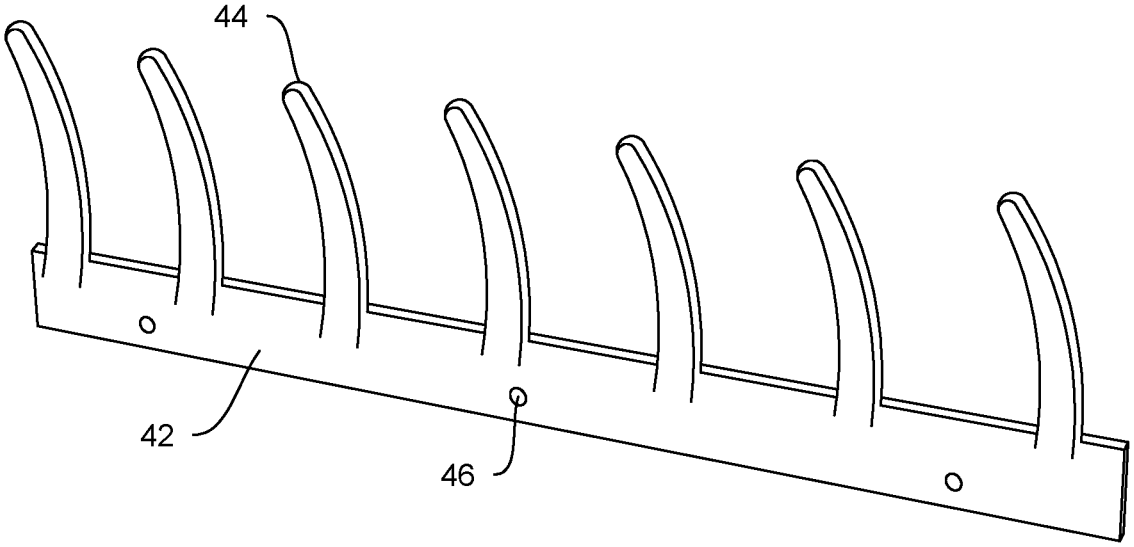
FIG. 3 is a representation of the retainer assembly according to one embodiment.

As depicted in FIG. 3, the retainer assembly 40 may be formed by a mounting strip 42 having openings and a plurality of tines 44. In a preferred embodiment, the retainer assembly 40 may be constructed in monolithic fashion. In other embodiments, the plurality of tines 44 may be modular to be further attached to the mounting strip 42. The retainer assembly 40 may be constructed from durable, sturdy and resistant materials. For instance, materials such as metals, plastics, ceramics, fibers, or the like, may be used to manufacture the retainer assembly 40. In one embodiment, mounting stripe 42 may have an elongated rectangular shape that may span the width of the rear side 22 of the drawer assembly 20. However, the length of the mounting strip 42 may vary according to operational requirements. It should be noted that one requirement of the mounting strip is that its length should be less than or equal to the width of the rear side 22. The plurality of tines 44 may be disposed along the longitudinal edge of the mounting strip 42 and may protrude upwardly therefrom. Each tine from the plurality of tines 44 may be equidistant from one another. In a suitable embodiment, the plurality of tines may be curled and be upstanding with respect to the mounting strip 42. In one embodiment, each tine may taper from its base to its top distal end. Additionally, the mounting strip 42 is mounted to the rear side 22 of the drawer 20 by means of fasteners that may be inserted through the openings 44 as depicted in FIG. 2A.

Figure 2B:
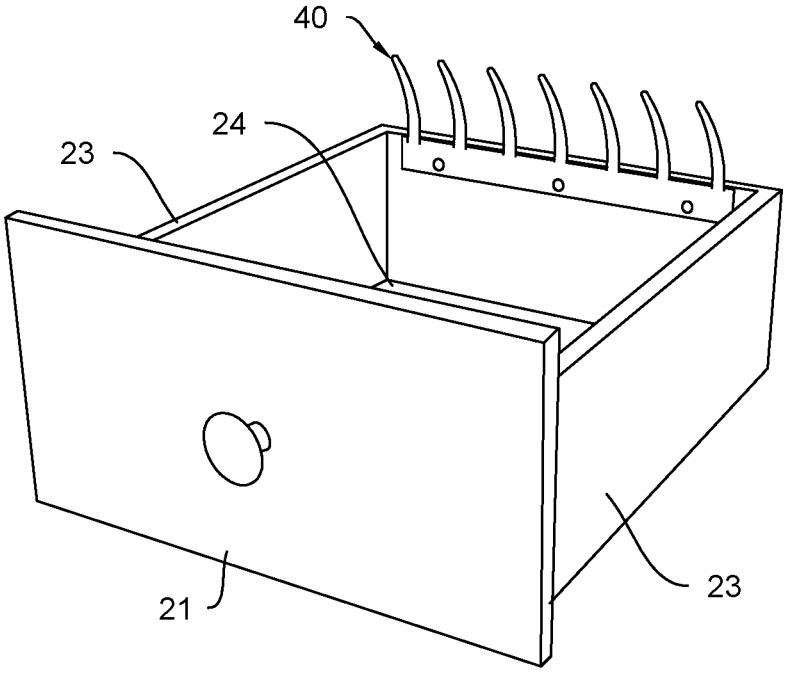
FIG. 2B illustrates an isometric view of the present invention according to one embodiment.

In a suitable embodiment, when the retainer assembly 40 is mounted to the rear side 22, the top edge of the mounting strip 42 (from where the plurality of curled upstanding tines extend) may align with the top edge of the rear side 22 as illustrated in FIG. 2B. The drawer assembly 20, designed with an open top, is intended for storing various items such as clothes. As these items are placed inside the drawer assembly 20, they may form a pile that may sometimes exceed the internal dimensions bounded by the front 21, rear 22, and lateral 23 walls of the drawer assembly 20. However, the ingenuity of the retainer assembly lies in its design. The plurality of curled upstanding tines 44 may extend above the topmost perimeter of the drawer assembly. The plurality of curled upstanding tines 44 serve as an effective barrier, preventing the contents from spilling out the backside of the drawer assembly 20. This means that even when the drawer's contents stack up beyond the usual capacity, the retainer assembly 40 ensures that everything remains contained within the drawer. Conversely, similar inventions such as references "414" and "116" as described above, teach a retaining piece that levels with the top contour of the walls that define the drawer. The retaining assembly with the plurality of curled upstanding tines 44 acts as a more robust safeguard against spillage and disarray. By extending above the height of the drawer's walls, it effectively prevents items from falling out, even when the contents exceed the usual capacity or when the drawer is opened abruptly, as it may happen to slide-out drawers. Since retaining pieces flush with the upper edge of the drawer may partially cover the open end of the drawer, it may complicate retrieval of the drawer's content. Whereas the design as defined in the appendaged claims, do not hinder the user's ability to reach and retrieve objects.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An item retaining device for drawers, comprising:

a drawer assembly having a rear side and drawer slides to define a slide-out drawer;

wherein said drawer is mounted into a drawer cabinet;

a retainer assembly formed by a mounting strip including a plurality of curled upstanding tines, said retainer assembly is mounted to the rear side of the slide-out drawer to prevent items from falling out a back side of the slide-out drawer.

2. The item retaining piece for drawers of claim 1, wherein the mounting strip has an elongated rectangular shape.

3. The item retaining piece for drawers of claim 2, wherein a length of the mounting strip is less than or equal to a width of the rear side.

4. The item retaining piece for drawers of claim 1, wherein the mounting strip further includes openings disposed along a longitudinal section thereof to receive fasteners therethough to secure the retainer assembly on the rear side.

5. The item retaining piece for drawers of claim 1, wherein each tine from the plurality of curled upstanding tines is equidistant from one another.

6. The item retaining piece for drawers of claim 1, wherein the plurality of curled upstanding tines extends from a top edge of the mounting strip.

7. The item retaining piece for drawers of claim 1, wherein each tine from the plurality of curled upstanding tines tapered from its base to its top end.

8. The item retaining piece for drawers of claim 1, wherein when the retainer assembly is mounted on the rear side of the drawer, the plurality of curled upstanding tines extends past an uppermost periphery of the drawer assembly.

9. An item retaining device for drawers, comprising:

a drawer assembly having a rear side and drawer slides located at outer surfaces of lateral sides of the drawer to define a slide-out drawer;

wherein said slide-out drawer is mounted into a drawer cabinet;

a retainer assembly formed by a mounting strip including a plurality of curled upstanding tines that extend from a top edge of the mounting strip, wherein the mounting strip has an elongated rectangular shape, said mounting strip having openings centrally disposed along a longitudinal section of the mounting strip, said openings are configured to receive fasteners, said retainer assembly is mounted to the rear side of the slide-out drawer to prevent items from falling out a back side of the slide-out drawer.

10. An item retaining device for drawers, consisting of:

a drawer assembly having a rear side and drawer slides located at outer surfaces of lateral sides of the drawer to define a slide-out drawer;

wherein said slide-out drawer is mounted into a drawer cabinet;

a retainer assembly formed by a mounting strip including a plurality of curled upstanding tines that extend from a top edge of the mounting strip, wherein the mounting strip has an elongated rectangular shape, said mounting strip having openings centrally disposed along a longitudinal section of the mounting strip, said openings are configured to receive fasteners, said retainer assembly is mounted to the rear side of the slide-out drawer to prevent items from falling out a back side of the slide-out drawer, when the retainer assembly is mounted on the rear side, the plurality of curled upstanding tines extend past an uppermost periphery of the drawer assembly, wherein each tine has a tapered shape.

* * * * *